United States Patent [19]

Barney

[11] 3,996,436

[45] Dec. 7, 1976

[54] SNAP ACTION SWITCH

[75] Inventor: Charles Azel Barney, Stow, Mass.

[73] Assignee: Ark-Les Switch Corporation, Watertown, Mass.

[22] Filed: Apr. 4, 1975

[21] Appl. No.: 565,156

[52] U.S. Cl. ..... 200/67 A
[51] Int. Cl.[2] ..... H01H 13/28
[58] Field of Search ..... 200/67 A, 67 D, 67 R; 74/97, 98

[56] References Cited

UNITED STATES PATENTS

| | | | |
|---|---|---|---|
| 2,823,283 | 2/1958 | Malone | 200/67 D |
| 3,042,770 | 7/1962 | Beeman | 200/67 D |

FOREIGN PATENTS OR APPLICATIONS

| | | | |
|---|---|---|---|
| 9,697 | 9/1908 | United Kingdom | 200/67 A |

*Primary Examiner*—David Smith, Jr.

[57] ABSTRACT

A double pole snap action switch operable by opposite movements of an operating lever having operating means comprising a bifurcated actuating lever having transversely spaced side legs mounted on a pivot, the free end of the actuating lever having transversely extending insulating portions connected to the movable terminals, and an operating lever mounted on the pivot. The operating lever has an external lever portion on the outer side of the pivot and an internal lever portion on the inner side of the pivot extending in the same direction as the actuating lever, positioned between the side legs thereof and having its free end spaced toward the pivot from the free end of the actuating lever. A compression spring is interposed between the free end of the actuating lever and the inner free end of the operating lever, so that movement of the external portion of the operating lever from one of its stable operating positions into parallelism with the actuating lever compresses the spring, the spring expanding when the levers pass through parallelism to move them and the movable terminals into their opposite stable positions.

1 Claim, 6 Drawing Figures

SNAP ACTION SWITCH

This invention relates to double pole electrical switches of the snap action type.

It is a major object of the present invention to provide a novel double pole snap action switch which operates in a predictable manner even when its operating lever is moved slowly, as, for example, by a float, to operate a pump.

It is another object of the present invention to provide a novel double pole snap action switch having relatively few and simple parts.

It is still another object of the present invention to provide a novel double pole snap action switch of improved reliability.

According to the present invention, there is provided a double pole snap action switch, operable by opposite movements of an operating lever, comprising an insulating housing, a pair of transversely spaced fixed and movable terminals mounted in the housing on opposite sides thereof with operating means therebetween for moving the movable terminals between a stable position in contact with the fixed terminals and a stable position out of contact with the fixed terminals. The operating means comprises lever pivot means in the housing, a bifurcated actuating lever with transversely spaced side legs mounted in the housing on the pivot means for pivotal movement thereon, the free end of the actuating lever having transversely extending insulating portions connected to the movable terminals and an operating lever mounted in the housing on the pivot means for pivotal movement thereon. The operating lever has an external lever portion on the outer side of the pivot means extending at least in part externally of the housing and an internal lever portion on the inner side of the pivot means extending in the same direction as actuating lever, preferably positioned between the side legs thereof, and having its free end spaced toward the pivot means from the free end of the actuating lever. A compression spring is interposed between the free end of the actuating lever and the inner free end of the operating lever and extends beyond the inner free end of the operating lever, preferably between the side legs of the actuating lever. The compression spring normally maintains the actuating lever in one of its two opposite angularly displaced stable positions, angularly displaced from and on opposite sides of the inner end of the operating lever, and the operating lever in one of its two opposite angularly displaced stable positions with its inner end portion similarly angularly displaced from the actuating lever. Movement of the external portion of the operating lever from one of its stable operating positions into parallelism with the actuating lever compresses the spring means, which expands when the levers pass through parallelism to move them and the movable terminal into their opposite stable positions.

For the purpose of more fully explaining above and still further objects and features of the present invention, reference is now made to the following detailed description of a preferred embodiment thereof, together with the accompanying drawings, wherein.

Figure 1:
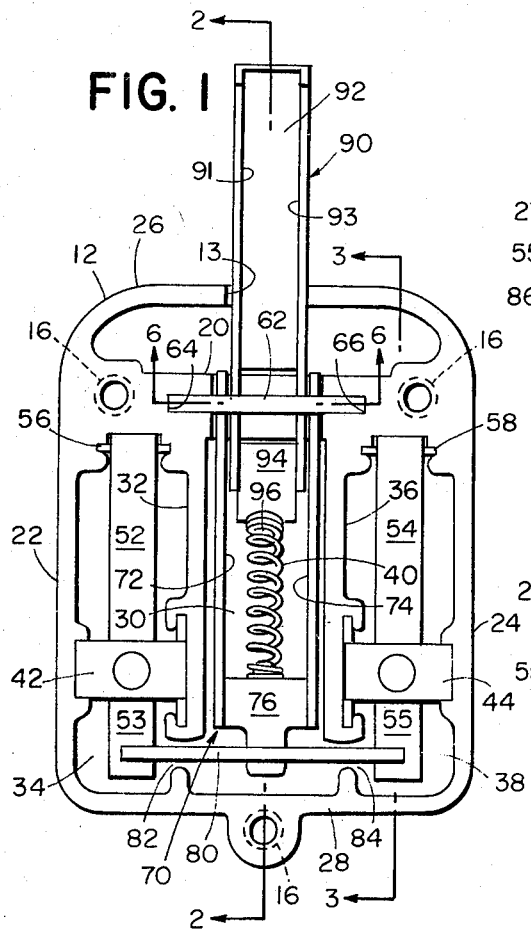
FIG. 1 is a top view of the double pole snap action switch of the invention, with its top cover removed for clarity.
Figure 3:
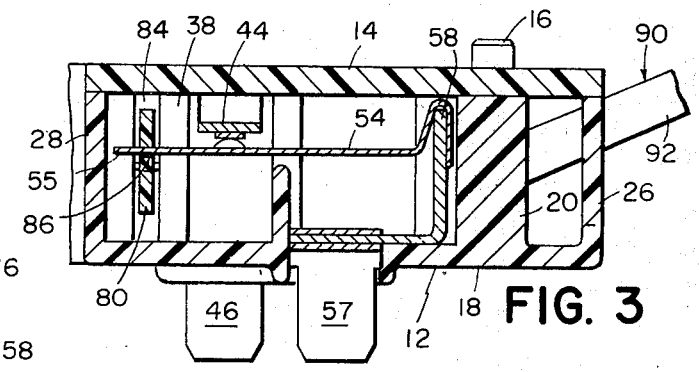
FIGS. 2 and 3 are, respectively, longitudinal central and displaced side sectional view of the switch of FIG. 1, with its terminals in closed position.
Figure 5:
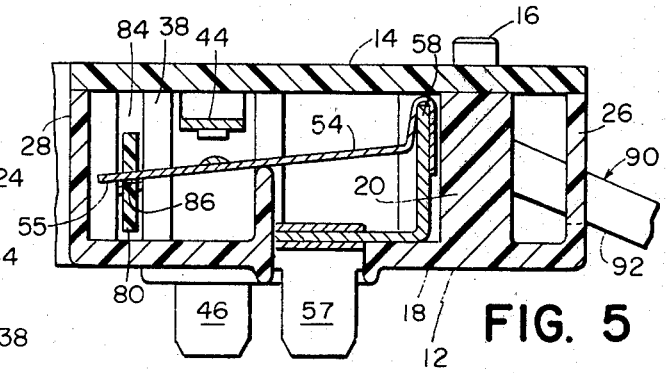
Figure 2:
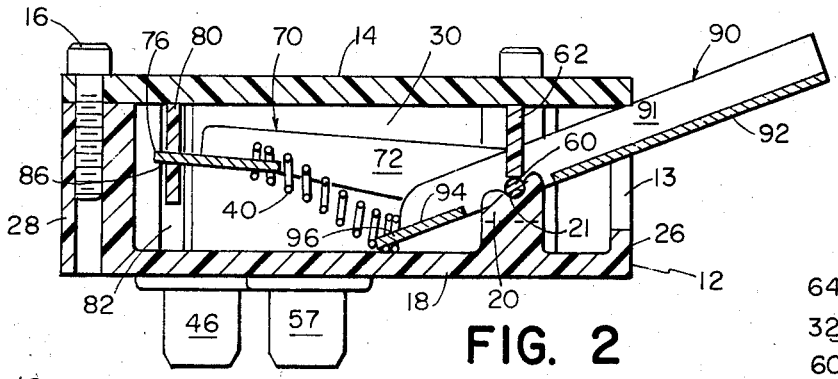
Figure 6:
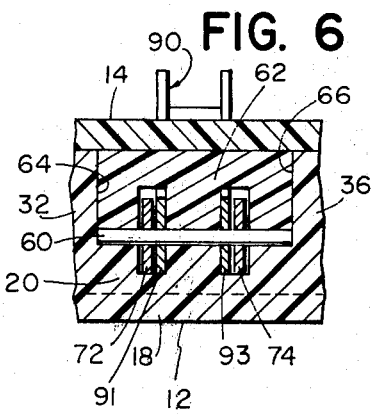
Figure 4:
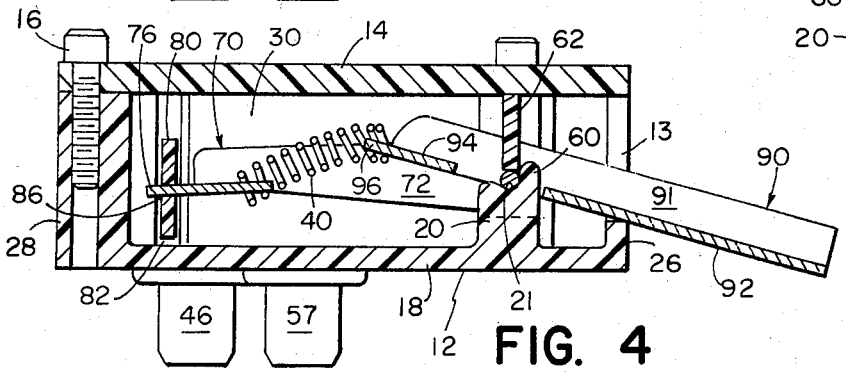

FIGS. 4 and 5 are views similar to those of FIGS. 2 and 3 with the switch terminals in open position; and FIG. 6 is a partial end sectional view of the switch of FIGS. 1 through 3.

Referring to the drawings, the snap action switch of the invention includes an insulating housing, generally designated 12, suitably molded of electrical insulating plastic material with an insulating plastic top cover 14, shown removed in FIG. 1. A plurality of screws 16 may be used to attach top cover 14 to housing 12 and to any suitable mounting base, not shown. Housing 12 has a bottom wall 18 and longitudinally extending side walls 22, 24 connected by end walls 26, 28. A pair of transversely spaced longitudinally extending interior walls 32, 36 divide the interior into three longitudinally extending compartments, central compartment 30 and side compartments 34, 38. A transverse interior wall 20 extends between side walls 22, 24.

Within housing 12 is mounted a pair of transversely spaced fixed terminals 42, 44, each mounted adjacent a side wall of said housing, fixed terminal 42 in side compartment 34 adjacent side wall 22 and fixed terminal 44 in side compartment 38 adjacent side wall 24. Fixed terminals 42, 44 extend outside of the housing beyond the bottom wall 18 thereof as spade connectors 46.

A pair of movable resilient terminals 52, 54 cooperating with said fixed terminals are also mounted within housing 12, each being mounted at one end in the housing and extending along a side wall thereof with its free end movable in and out of contact with a cooperating fixed terminal, 42, 44, respectively. More specifically, movable resilient terminals 52, 54 extend longitudinally within side compartments 34, 38 respectively, resilient terminal 52 being mounted at one end on fixed connector 56 and resilient terminal 54 being mounted on fixed connector 58. Fixed connectors 56, 58 each extend through and beyond the bottom wall 18 of housing 12 as spade connectors 57.

According to the present invention, there is provided operating means for moving the free ends 53, 55 of resiliently movable terminals 52, 54, respectively, between a stable position in contact with fixed terminals 42, 44, respectively, and a stable position out of contact with said fixed terminals. More specifically, such operating means includes a transversely extending pivot shaft 60 mounted in central compartment 30 of housing 12 adjacent one end wall 26 thereof, said shaft being supported in underlying depressions 21 of transverse wall 20 and extending across central compartment 30. An overlying clamp member 62, supported at its ends in slots 64, 66 in interior longitudinal walls 32, 36, respectively, is pressed downwardly by cover 14 against pivot shaft 60 to hold it in position. A longitudinally extending bifuracated actuating lever, generally designed 70, having transversely spaced side legs 72, 74 is mounted at one end generally centrally in housing 12 in central compartment 30 on pivot shaft 60 for pivotal movement thereon. The free opposite end 76 of said actuating lever has mounted thereon a transversely extending link member 80 of insulating material, which extends from central compartment 30 through apertures 82, 84 in interior walls 32, 36, respectively, into side compartments 34, 38, respectively. The ends of link member 80 within side compartments 34, 38 are provided with slots 86 for receiving therein the free ends 53, 55 of resilient terminals 52, 54 for connection thereto. Housing bottom wall 18 acts as a stop and defines one of the stable positions of actuating lever 70

(FIG. 4). The other stable position of actuating lever 70 is defined by the contact of the terminals (FIG. 2).

A longitudinally extending operating lever, generally designated 90, is mounted between the side legs 72, 74 of actuating lever 70 generally centrally in housing 12 on pivot shaft 60 for pivotal movement thereon. Operating lever 90 has two parallel spaced side legs 91, 93 and includes an external lever portion 92 on the outer side of pivot shaft 60 extending externally of housing 12 through slot 13 and an internal lever portion 94 on the inner side of pivot shaft 60 extending in the same direction as actuating lever 70, positioned between the side legs 72, 74 thereof and having its free end 96 spaced toward pivot shaft 60 from the free end 76 of actuating lever 70. The stable operating positions of operating lever 90 are defined by the ends of slot 13, which act as stops.

A compression coil spring 40 is interposed between the free end 76 of actuating lever 70 and the inner free end 96 of operating lever 90 and extends beyond the inner free end 96 of operating lever 90 and between the side legs 72, 74 of actuating lever 70.

In operation, compression spring 40 normally maintains actuating lever 70 in one of its two opposite angularly displaced stable positions angularly displaced from and on opposite sides of the inner end 96 of operating lever 90 and also maintains the operating lever in one of its two opposite angularly displaced stable positions with its inner end 96 portion similarly angularly displaced from actuating lever 70, as is illustrated in FIGS. 2 and 4. Movement of the external portion 92 of operating lever 90 from one of its stable operating positions into parellelism with actuating lever 70 compresses spring 40, the spring expanding when the levers 70 and 90 pass through parallelism to rapidly move the levers and the movable terminals into their opposite stable positions. Thus, a slow movement of operating lever 90 results in a snap action operation of the switch terminals.

What is claimed is:

1. A snap action switch operable by opposite movements of an operating lever comprising an insulating housing having a pair of transversly spaced longitudinally extending interior walls providing two side compartments and a central compartment and a transverse interior wall extending between said longitudinally extending interior walls across said central compartment adjacent one end thereof, said transverse wall having a transversely extending depression means on its upper surface an insulating cover for said housing a pair of fixed terminals, each mounted in one of said side compartments adjacent a side wall of said housing, and a pair of movable terminals, each mounted in one of said side compartments adjacent one end of said housing and extending along a side wall thereof with its free end movable in and out of contact with a cooperating fixed terminal, and operating means for moving the free ends of said movable terminals between a stable position in contact with said fixed terminals and a stable position out of contact with said fixed terminals said operating means including lever pivot means including a transversely extending pivot shaft mounted in depression means in said transverse interior wall an overlying clamp member pressed downwardly by said cover against said pivot shaft a longitudinally extending bifurcated actuating lever having transversely spaced side legs mounted generally centrally in said housing in said central compartment on said pivot shaft for pivotal movement thereon, the free end of said actuating lever having transversely extending insulating portions extending through said longitudinally extending interior walls and connected to the free ends of said movable terminals in said side compartments a longitudinally extending operating lever mounted generally centrally in said housing in said central compartment on said pivot shaft for pivotal movement thereon, said operating lever having an external lever portion on the outer side of said pivot shaft extending at least in part externally of said housing and an internal lever portion on the inner side of said pivot shaft extending in the same direction as said actuating lever, positioned between the side legs thereof and having its free end spaced toward said pivot shaft from the free end of said actuating lever and a compression spring interposed between the free end of said actuating lever and the inner free end of said operating lever and extending beyond the inner free end of said operating lever and between the side legs of said actuating lever said compression spring normally maintaining:

said actuating lever in one of its two opposite angularly displaced stable positions angularly displaced from and on opposite sides of the inner end of said operating lever and said operating lever in one of its two opposite angularly displaced stable positions with its inner end portion similarly angularly displaced from said actuating lever whereby movement of the external portion of said operating lever from one of its stable operating positions into parallelism with said actuating lever compresses said spring, said spring expanding when said levers pass through parallelism to move said levers and said movable terminals into their opposite stable positions.

* * * * *